US005495967A

United States Patent [19]

Parton

[11] Patent Number: 5,495,967

[45] Date of Patent: Mar. 5, 1996

[54] UNOBTRUSIVE CARRIER HAVING QUICK RELEASE ACCESS FOR PROTECTIVE DEVICES

[75] Inventor: Katherine E. Parton, Scottsdale, Ariz.

[73] Assignee: Hoosier Investment Company, Scottsdale, Ariz.

[21] Appl. No.: 324,715

[22] Filed: Oct. 18, 1994

[51] Int. Cl.[6] ..... A45F 3/02

[52] U.S. Cl. ..... 224/202; 224/911; 224/914; 224/243; 190/106

[58] Field of Search ..... 224/202, 911, 224/914, 224, 901, 243, 245, 240, 235; 150/120, 123; 190/106, 121, 109, 110; 383/33, 34

[56] References Cited

U.S. PATENT DOCUMENTS

| | | | |
|---|---|---|---|
| 448,139 | 3/1891 | Mayer | 190/106 |
| 2,707,505 | 5/1955 | Klehr | 190/121 |
| 2,875,802 | 3/1959 | Koret | 150/123 |
| 3,176,741 | 4/1965 | Brenner | 190/106 |
| 4,368,767 | 1/1983 | Friedman | 150/120 |
| 4,386,642 | 6/1983 | Durbin | 190/110 |
| 4,463,789 | 8/1984 | Leiserson | 190/110 |
| 4,966,320 | 10/1990 | DeSantis et al. | 224/911 |
| 5,060,767 | 10/1991 | Pulichino et al. | 190/109 |
| 5,305,874 | 4/1994 | McLaughlin | 224/914 |
| 5,374,919 | 12/1994 | Zelka et al. | 224/914 |

FOREIGN PATENT DOCUMENTS

| | | | |
|---|---|---|---|
| 848254 | 10/1939 | France | 150/123 |
| 1137032 | 5/1957 | France | 150/120 |
| 175491 | 2/1935 | Switzerland | 150/120 |

*Primary Examiner*—Henry J. Recla
*Assistant Examiner*—Gregory M. Vidovich
*Attorney, Agent, or Firm*—Richard R. Mybeck; Peter B. Scull

[57] ABSTRACT

An unobtrusive carrier for self-protective devices is disclosed. Such a carrier has a body portion to which is connected a carrying strap. The body portion has a special secret compartment which is solely accessible by a spring-biased opening at one end of the body portion. The spring-biased opening comprises a frame assembly having two frame members pivotally connected to each other such that they can alternately be held in closed position against the spring-biasing or snapped to open position by the spring arms when a catch is released. A holster is provided within the secret compartment.

17 Claims, 1 Drawing Sheet

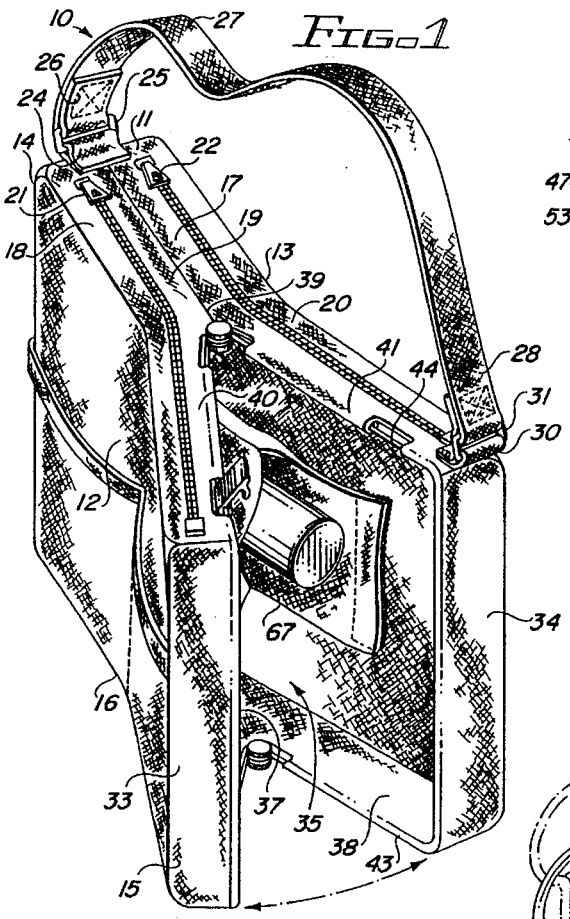
FIG. 1
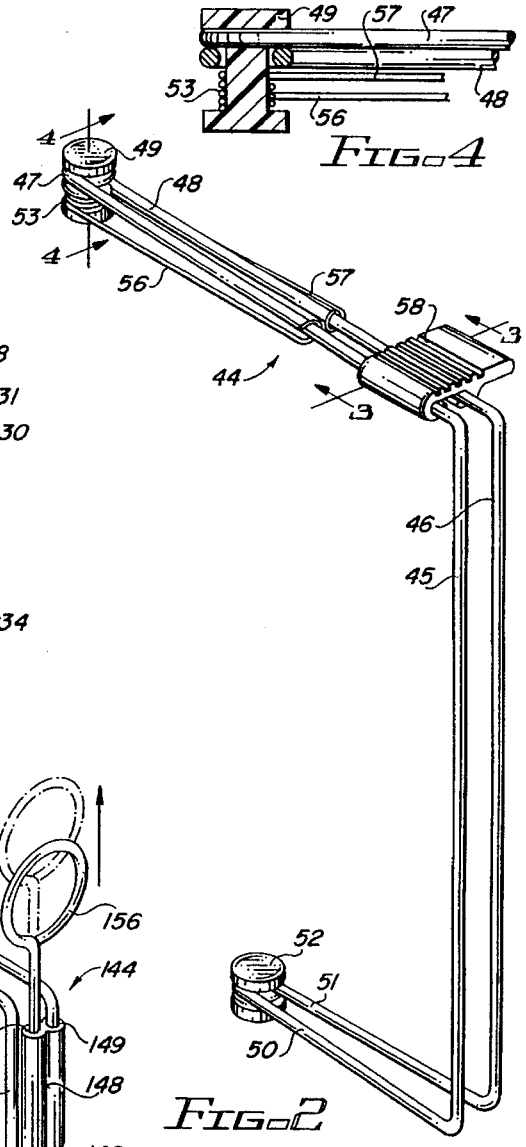
FIG. 4
FIG. 2
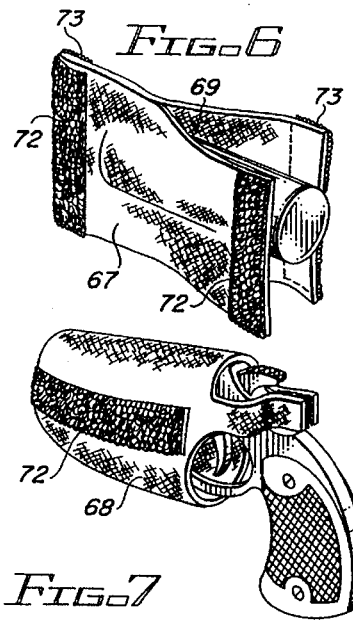
FIG. 6
FIG. 7
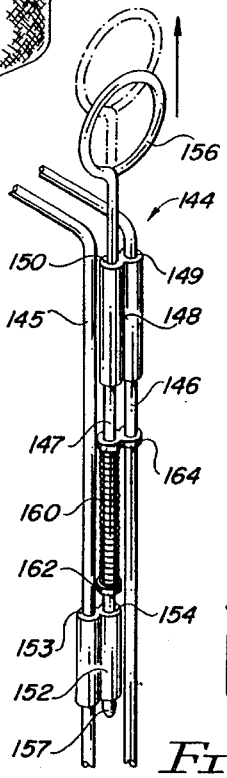
FIG. 5
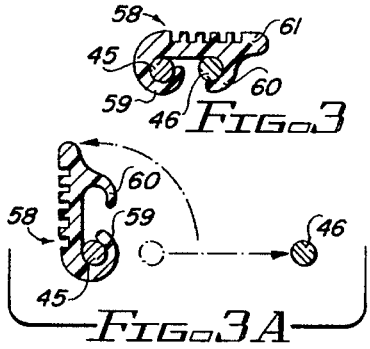
FIG. 3
FIG. 3A

UNOBTRUSIVE CARRIER HAVING QUICK RELEASE ACCESS FOR PROTECTIVE DEVICES

INTRODUCTION

The present invention relates generally to an unobtrusive carrier having quick-release access and more particularly to a compartmentalized bag of conventional appearance having holster means discretely defined therein and a quick opening spring-biased compartment defined thereabout to provide the user thereof with quick and ready access to a protective device, such as a pistol, a mace can, a pepper spray or the like secured therein and shrouded thereby to enable the user to defend him or herself from marauders, rapists, robbers and other hostile approaches to his or her person, particularly when the user travels alone.

BACKGROUND OF THE INVENTION

The need for self protection, particularly for young adult females, has never been greater. Moreover, such protection is not limited to the female population because not a day passes without one or more headlines screaming of the murder, rape or robbery of another defenseless victim. Even more shocking is the fact that such incidents are not limited to remote areas but are occurring "down town" and in many posh suburban shopping centers.

Historically, self-defense devices have been worn on the person. Depending upon the period, swords, knives, or firearms have been in vogue. However, all such devices required a carrying means of some sort and most of the improvements thereof were intended to allow quick and ready access. Today, although a person desiring to carry an instrument of self-defense often still requires a visible carrying means so as not to run afoul of many gun control laws, there are States which allow the carrying of a concealed weapon so long as one complies with the proper permit requirements. Legality notwithstanding, there are significant problems of structurally providing thorough concealment while also making the self-protection device quickly and readily accessible for immediate use.

The prior art has attempted to deal with some of these and other desiderata with varying degrees of success. For instance, Bianchi (I) (U.S. Pat. No. 3,630,420) describes a quick access, open front holster including an inner liner and an outer facing which encase the barrel and the cylinder portions of a revolver. The front slot is held in a generally closed position by a "U" shaped spring which extends around the perimeter of the front opening of the holster. The spring bias maintains a firm pressure at the front periphery of the holster to secure the gun therewithin. The front opening is further provided with a snap secured strap which ensures that the pistol cannot be dislodged or otherwise unintentionally fall from the holster. In use, the wearer may easily draw the gun by grasping the exposed handle, using an index finger to open the safety strap fastener, and removing the revolver forwardly out of the holster.

Jones (U.S. Pat. No. 3,904,091) teaches a sidearm holster having a latchable flap or strap composed of a spring metal strip having one end anchored in the rear portion of the holster. The flap crosses over the pistol between the hammer and the handle and connects into a latching mechanism on the outside of the holster. A spring loaded latch holds the free end of the strap in place, thereby securing the gun in the holster.

In use, the wearer pushes a button at the bottom of the holster which releases the spring loaded latch from a specially configured spring steel strip. The strip springs away from the top of the gun and allows the wearer to draw the gun from the holster.

Bianchi et al. (II) (U.S. Pat. No. 4,101,060) also teach a front opening holster in which the front opening is maintained in a "closed" position by the bias of a pair of inverted "U" shaped spring members which extend from the closed rear edge of the holster, over the weapon and downward to the lower end of the front of the holster. The spring members are sewn between the shell and liner of the holster, are mechanically coupled at their innermost ends and are free at the front opening so that the entire front opening exhibits a substantially uniform resistance to opening. Closure straps are formed integrally with the holster body and overlie the hammer region of the handgun. The closure straps include recessed directional snaps which allow opening only upon the forward movement of the user's hand.

When the user desires to draw the weapon, he grips the handle of the gun and with his thumb releases the snap. The spring biased front of the holster provides a uniform resistance which decreases muzzle drag on the gun and allows the wearer to draw the gun smoothly and rapidly in a single motion.

Shoemaker (U.S. Pat. No. 4,580,707) teaches a spring release adjustable shoulder holster for wear beneath an outer jacket. The gun lies vertically within the holster with the butt facing forward and, as with other shoulder holsters, is to be drawn cross-body of the wearer. The rear of the holster is spring biased in a manner similar to Bianchi. The spring members are formed as a "W" shape from a single piece of wire which is mounted from the center point of the wire to the front of the holster. The portions of the wire are over-biased to create a generally uniform resistance to the rear opening.

When the wearer wishes to draw the pistol, he grips the handle of the pistol and withdraws it across his body against the biased force of the closure springs.

DeSantis et al. (I) (U.S. Pat. No. 4,966,320) and DeSantis et al. (II) (U.S. Pat. No. 5,170,919) each teach a handgun holster which is completely concealed by an ordinary carrying pouch. The holster is attached to a back portion mounted on the wearer while a front portion comprising the ordinary carrying pouch is integrally yet only partially attached to the back portion. The top and at least one side of the front portion fold over and are attached by Velcro® to the back portion to enclose the holster in an inner area for storing the handgun. An attached belt allows the wearer to wear the pouch around his/her waist. The outward facing portion of the pouch may have actual zippered pockets for carrying ammunition or other articles, or the pockets may be only simulated.

Should the wearer have need to draw the weapon, he or she need only grip the flap of the pouch and pull which releases the Velcro® strips and allows the flap to be torn away from the back portion and expose the holster and gun, thereby providing easy and rapid access to the weapon.

However, in spite of previous attempts to provide an ideal unobtrusive weapon carrier for protection of oneself against the social predators that run rampant on our streets, none accomplished completely the portability and smooth operation necessary to achieve quick and reliable access to a stored weapon without alerting the predator that the designated victim is capable of self-defense. It is toward this goal that the present invention is directed.

BRIEF SUMMARY OF THE INVENTION

The present invention relates generally to an unobtrusive carrier having quick-release access for protective devices contained or holstered therein and more particularly to a shoulder carried attache, briefcase or purse-like structure having a spring biased compartment accessible through an opening in one edge of the carrier in which self-protective devices such as a pepper spray, a mace dispenser or a handgun can be unobtrusively stored. Thus, the carrier provides quick and easy access to the self-protective device should the sudden need for its use arise. Furthermore, the carrier device is constructed so that, when worn over the shoulder with a strap, the closed compartment is disposed in the body portion of the device separate from and independent of one or more main storage areas and is accessed quickly by one hand releasing the locking means to activate a spring-biased frame assembly which pops open the front of the compartment and allows ready access to the self-protective device mounted therewithin.

Accordingly, it is a prime object of the present invention to provide an unobtrusive, conventionally appearing means for transporting a defensive weapon in such a manner that it is not readily visible and yet remains quickly and easily retrievable when needed for the self-protection of the bearer from an unwanted assault.

A still further object of the present invention is to provide a novel and unique attaché or purse-like structure which contains therewithin a discrete spring-biased compartment for storing, and a single handed actuator for opening to allow ready retrieval of a defensive weapon mounted therein.

These and still further objects as shall hereinafter appear are readily fulfilled by the present invention in a remarkably unexpected manner as will be readily discerned from the following detailed description of an exemplary embodiment thereof especially when read in conjunction with the accompanying drawings in which like parts bear like numerals throughout the several views.

BRIEF DESCRIPTION OF THE DRAWINGS

In the drawings:

FIG. 1 is an isometric view of an unobtrusive carrier embodying the present invention in its open position;

FIG. 2 is an isometric view of the latch-frame assembly which is an integral part of the carrier of FIG. 1 in its closed position;

FIG. 3 is a cross-sectional view of the latch-frame assembly of FIG. 2 taken on line 3—3;

FIG. 3A is another cross-sectional view of the latch-frame assembly as shown in FIG. 3 when it is moved to its open position;

FIG. 4 is a fragmented cross-sectional view of the latch-frame assembly of FIG. 2 taken on line 4—4;

FIG. 5 is a fragmented isometric view of an alternative latch-frame assembly shown in its closed position;

FIG. 6 is an isometric view of a holster for use in the unobtrusive carrier of FIG. 1; and FIG. 7 is an isometric view of an alternative holster for use in the unobtrusive carrier of FIG. 1.

DESCRIPTION OF PREFERRED EMBODIMENT

The present invention relates generally to an unobtrusive carrier for self-protection devices which provides quick access to such a device in case of emergency. The carrier is identified in the drawings by the general reference 10.

As shown in FIG. 1, carrier 10 comprises a body portion 11 having a first side panel 12, a second side panel 13, a trailing end panel 14, a leading end panel 15, a bottom panel 16 and an upper panel 17. Upper panel 17 comprises a first strip 18, a second strip 19, and a third strip 20 which are defined by the placement of suitable closure means such as first zipper 21 and second zipper 22 therein in spaced generally parallel relationship to each other. The several panels are further sewn together or otherwise attached as will be explained below.

At the intersection of trailing end panel 14 and upper panel 17, suitable means such as one or more loops 24 are attached to receive and secure a ring 25 through which is threaded first end 26 of a suitable shoulder strap 27. Shoulder strap 27 also has a second end 28 which is threaded through a similar assembly attached at the intersection of leading end panel 15 with upper panel 17. One or more loops 30 are attached hereto and ring 31 is similarly secured in loops 30 to receive second end 28 of shoulder strap 27.

As shown in FIG. 1, carrier 10 comprises a body portion 11 including one or more principal storage compartments (not directly shown) which are accessible by one or more suitable closure means such as zippers 21, 22. As is conventionally known, zippers 21 and 22 are operative to open and shut carrier 10 for the storage of and access to the usual worldly things normally carried in the principal storage compartments of one's purse or attaché case. Of course, alternative embodiments could foreseeably make use of, for example, one zipper opening into a plurality of compartments or a plurality of zippers opening into single, respective compartments. Be that as it may, it is preferable that at least two compartments be formed, one each on opposite sides of and concealing a special storage chamber 35 which is described below.

Leading edge panel 15 is formed by the mating of two sections, namely, a first strip 33 and a second strip 34 each of which are secured as by sewing to an adjacent side panel 12 or 13, respectively, and are separable in a manner to be hereinafter described to expose a special, secret storage chamber 35.

As is further shown in FIG. 1, special storage chamber 35 is defined by and between a first interior panel 37 and a second interior panel 38. Each interior panel is respectively attached as by sewing one end thereof to its corresponding strip 33, 34 of leading end panel 15 and by sewing the other end of each to the interior of trailing end panel 14 of body portion 11. Panels 38 are also sewn or otherwise attached to upper panel 17 at their upper edges as shown at common seam 39. Seam 39 is shown in FIG. 1 where it bisects strip 19 of upper panel 17 for more than half of the length of carrier 10. The lower edges of panels 37, 38 are likewise sewn or otherwise secured to bottom panel 16 for an even longer portion of the length of carrier 10. However, to complete chamber 35 which can be accessed only through leading end panel 15, short portions of panels 37 and 38 are not connected in common to the upper and bottom panels but are separate and connected only to respective portions of upper panel 17, leading end panel 15 and bottom panel 16. The connection of the upper edge of panel 37 to panel 17 is at a seam shown for example at or near area 40 in FIG. 1. Likewise, a seam at 41 shows the connection of panel 38 to panel 17. The lower edge panel connections are similarly attached as shown for example at a seam at or near area 43 where panel 38 is connected to bottom panel 16. Latch frame assembly 44 is sewn into these connection seams in any conventional manner so long as it is generally positioned as shown in FIG. 1.

Referring now to FIGS. 2, 3 and 4, latch-frame assembly 44 is shown in detail apart from carrier 10. Assembly 44 has two principal frame members, a first member 45 and a second member 46. Members 45 and 46 are pivotally attached to each other at their respective upper ends 47 and 48 by pivotal connector 49. Similarly, members 45 and 46 are connected at their respective lower ends 50 and 51 by a pivotal connector 52.

A coiled spring 53 is further attached to assembly 44 to bias assembly 44 in its open position as shown in FIG. 1. In the preferred embodiment as shown in FIGS. 2 and 4, the coiled portion of spring 53 is wrapped around a downwardly extending portion of pivotal connector 49 at the connection point of upper ends 47, 48 of frame members 45, 46. Spring 53 also has two elongated arm portions 56 and 57 which extend outwardly from coil 53 and are respectively engaged one each with each of the inner surfaces of first and second frame members 45 and 46.

In a preferred practice of the present invention, latch-frame assembly 44 includes latch mechanism 58 which is shown in FIGS. 2 and 3. Mechanism 58 is pivotally attached to one of the two frame members 45, 46 by snap fitting the open part of the semi-cylindrical connection portion 59 about frame member 45, for example, in the position shown in FIG. 3. Assembly 44 may then be closed by detachably fixing semi-cylindrical catch portion 60 on the other frame member 46. Assembly 44 may then be opened as shown in FIG. 3A, by applying a certain minimal amount of upward manual pressure on lift portion 61 which frees catch portion 60 from member 46, thus allowing spring 53 to assume its pre-biased, open position such that arm portions 56 and 57 force open frame members 45 and 46 as shown in FIGS. 1 and 3A. Ready access to a self-protection device contained within compartment 35 is thus quickly obtained.

Referring now to FIG. 5, an alternative latch-frame assembly 144 is shown comprising a first frame member 145 and a second frame member 146 pivotally connected at their upper and lower ends by pivotal connectors (not shown) and a coiled spring member such as is described above to secure members 145 and 146 of alternative frame assembly 144 in pivotal abutting relationship to each other.

A cylindrical shaft 147 is slidably connected to assembly 144 to operably latch frame members 145 and 146 in closed position or unlatch them so they can assume an open position. Shaft 147 is slidably operable within top connection member 148 which is fixedly attached to frame member 146 at connection 149. An open cylinder 150 in connection member 148 allows free motion of shaft 147 in generally parallel relationship to frame members 145 and 146.

A similar, lower connection member 152 is fixedly attached to frame member 145 at connection 153 and allows for the slidable insertion of shaft 147 into hollow cylinder 154. Manual movement of shaft 147 upward by gripping handle 156 and pulling upwardly causes tip 157 to withdraw from cylinder 154. This withdrawal of tip 157 from cylinder 154 frees the coiled spring as described above (and shown in FIG. 4) from all restraint and enables frame members 145 and 146 to assume their pre-biased open position. Frame assembly 144 is thereby opened to the position shown in FIG. 1, and thus provides ready access to storage compartment 35.

A cylindrical compression spring 160 is circumscribed about shaft 147 and secured in place by a detent means 162 affixed to shaft 147 in spaced relationship to shaft tip 157. Spring 160 is operative to bear against detent means 162 to force downward or bias tip 157 in and through cylinder 154 and lock frame assembly 144 in its closed position. Further, however, detent means 162 is used to compress compression spring 160 against compression stop 164 when shaft 147 is moved upwardly. Stop 164 is fixedly attached to frame member 146 and allows shaft 147 to move slidably therethrough. Thus, spring 160 normally holds shaft 147 downward in closed position but when handle 156 is pulled upwardly with a force sufficient to offset the bias of compression spring 160, shaft 148 and detent 162 move upwardly and free tip 157 to open assembly 144.

In a preferred practice of the present invention, detachable pouch members or holsters 67 and 68 as shown in FIGS. 6 and 7 are configured to provide secure support for a small canister (such as a mace dispenser or a pepper spray) and/or a pistol or like defensive device which is insertable thereinto through an appropriate opening 69 defined therein. Holsters 67 and 68 are alternately and detachably attached to the inner surface of panels 37, 38 of carrier 10. Each of these panels have a vertically extending patch (not shown) formed of conventional hook-loop fastening fabric (VELCRO®) secured thereto approximately midway into compartment 35. Elongated strips 72, 73 of corresponding like fastening fabric are secured horizontally to the outer respective sides of holsters 67, 68 and coact with the hook-loop patches inside compartment 35 to attach holsters 67, 68 within compartment 35 at whatever position or angle may be required to support a particular defensive device within carrier 10.

From the foregoing, it is readily apparent that a new and useful embodiment of the present invention has been herein described and illustrated which fulfills all of the aforestated objects in a remarkably unexpected fashion. It is of course understood that such modifications, alterations and adaptations as may readily occur to the artisan confronted with this disclosure are intended within the spirit of this disclosure which is limited only by the scope of the claims appended hereto.

Accordingly, what is claimed is:

1. An unobtrusive carrier for a protective device comprising:

a body portion having top, bottom and opposite ends, each of said ends having a height extending from said top to said bottom; support means attached to said body portion, said body portion having defined therein one or more general purpose storage compartments accessible from said top and a discrete special storage compartment for storing a protective device, said discrete special storage compartment being independently accessible from the one or more general storage compartments through an opening disposed along the entire height of one of said opposite ends of said body portion and having a pivotally operable spring-biased frame means disposed about said opening and operatively associated with said opening to pivot about an axis extending between planes defined by said top and said bottom, respectively, to open said opening, said spring-biased frame means including operatively coupled first and second spring-biased frame members, said discrete special storage compartment further having an operable locking means operatively associated with said first and second spring-biased frame members of said spring-biased frame means to maintain said spring-biased frame means in a closed position when desired to prevent access into said discrete special storage compartment, and actuatable to empower the spring bias of said spring-biased frame means to move said spring-biased frame means into an open position to open said opening and provide ready access to said discrete special storage compartment.

2. An unobtrusive carrier according to claim 1 in which said spring-biased frame means comprises a spring means operatively associated with said first and second frame members to pivot said frame means into an open position.

3. An unobtrusive carrier according to claim 2 in which said spring means comprises a coiled spring member with two elongated arms connected to said frame means, said two elongated arms being biased to open away from each other.

4. An unobtrusive carrier according to claim 1 in which said operable locking means comprises a latch mechanism pivotally attached to said first frame member, said latch mechanism having a semi-cylindrical catch portion which detachably snaps onto said second frame member.

5. An unobtrusive carrier according to claim 4 in which said latch mechanism further has a lift portion which facilitates manually unlatching said catch portion.

6. An unobtrusive carrier according to claim 1 in which said operable locking means comprises a shaft slidably attached along and parallel to said first frame member, said shaft being insertable in a cylindrical opening fixedly attached to said second frame member.

7. An unobtrusive carrier according to claim 6 in which said shaft is further spring-biased into a fixed closed position by the coaction of a second spring means and a detent means.

8. An unobtrusive carrier according to claim 1 in which said body portion is a purse.

9. An unobtrusive carrier according to claim 1 which further comprises a holster means for holding a protective device detachably secured within said discrete special storage compartment.

10. An unobtrusive carrier according to claim 9 in which said holster means is secured in said special compartment with hook-and-loop fasteners.

11. An unobtrusive carrier according to claim 1 in which said protective device comprises a handgun.

12. An unobtrusive carrier according to claim 1 in which said protective device comprises a mace dispenser.

13. An unobtrusive carrier according to claim 1 in which said protective device comprises a pepper spray.

14. An unobtrusive carrier according to claim 9 in which said protective device comprises a handgun.

15. An unobtrusive carrier according to claim 9 in which said protective device comprises a mace dispenser.

16. An unobtrusive carrier according to claim 9 in which said protective device comprises a pepper spray.

17. A means for carrying and having quick access to a protective device comprising a carrier having a body portion with top, bottom and opposite ends, each of said ends having a height extending from said top to said bottom, support means attached to said body portion having defined therein at least one general purpose storage compartment accessible form said top and a discrete special storage compartment for storing a protective device, said discrete special storage compartment being independently accessible from the at least one general compartment through an opening disposed along the entire height of one of said opposite ends of said body portion and having a pivotally operable spring-biased frame means disposed about said opening and operatively associated with said opening to pivot about an axis extending between planes defined by said top and said bottom, respectively, to open said opening, said spring-biased frame means including operatively coupled first and second spring-biased frame members, said discrete special storage compartment further having an operable locking means operatively associated with said first and second spring-biased frame members of said spring-biased frame means in a closed position when desired to prevent access into said discrete special storage compartment, and actuable to empower the spring bias of said spring-biased frame means to move said spring-biased frame means into an open position to open said opening and provide ready access to said discrete special storage compartment.

* * * * *